US007275884B2

(12) United States Patent
Sassouni

(10) Patent No.: US 7,275,884 B2
(45) Date of Patent: Oct. 2, 2007

(54) FLUID DISPENSING DEVICE

(76) Inventor: K. Jacques Sassouni, 17 Barstow Rd., Suite 302, Great Neck, NY (US) 11021

( * ) Notice: Subject to any disclaimer, the term of this patent is extended or adjusted under 35 U.S.C. 154(b) by 0 days.

(21) Appl. No.: 11/480,052

(22) Filed: Jul. 3, 2006

(65) Prior Publication Data

US 2007/0025806 A1 Feb. 1, 2007

Related U.S. Application Data

(63) Continuation of application No. 11/190,686, filed on Jul. 27, 2005, now abandoned.

(51) Int. Cl.

| | |
|---|---|
| ***B43K 5/00*** | (2006.01) |
| ***B43K 8/12*** | (2006.01) |
| ***B43K 23/12*** | (2006.01) |
| ***B43K 5/14*** | (2006.01) |
| ***B43M 11/06*** | (2006.01) |

(52) U.S. Cl. ..... 401/202; 401/207; 401/262; 401/265; 401/132; 401/183

(58) Field of Classification Search ..... 401/132–135, 401/202–207, 183–186, 295, 329, 262, 265
See application file for complete search history.

(56) References Cited

U.S. PATENT DOCUMENTS 2,281,105 A * 4/1942 Marti et al. ..... 401/132
2,947,015 A * 8/1960 Burt ..... 401/183
2,962,743 A * 12/1960 Henriksson ..... 401/266
3,756,732 A * 9/1973 Stoffler ..... 401/202
4,480,760 A * 11/1984 Schonberger ..... 215/230
4,925,327 A * 5/1990 Wirt ..... 401/205
5,577,851 A * 11/1996 Koptis ..... 401/202

* cited by examiner

*Primary Examiner*—David J. Walczak
(74) *Attorney, Agent, or Firm*—Charles E. Temko

(57) ABSTRACT

A fluid dispensing device for applying fluids which dry and harden with exposure to ambient air, typically glues and the like. The device includes a sponge applicator. A flexible container element has a first thread for engaging a dispensing element, including the applicator. A neck portion of the container element includes a second thread on an outer surface thereof for selective engagement with a cap-like cover which encloses the sponge and prevents drying of the same during periods in which the device is not in use. The sponge includes an axially-aligned passage interconnecting directly with the neck portion, so that the squeezing of the container element transfers the dispensed fluid directly to an outer surface of the sponge for application to a treated surface.

1 Claim, 1 Drawing Sheet

FLUID DISPENSING DEVICE

RELATED APPLICATION

Reference is made to my non-provisional application, Ser. No. 11/190,686 filed Jul. 27, 2005, now abandoned to which a claim of priority is made. The present application is a continuation-in-part of that application.

BACKGROUND OF THE INVENTION

This invention relates generally to the field of fluid dispensing devices, and more particularly to devices of this type employed for fluids which harden and dry upon exposure to ambient air and are applied as a coating. Typical fluids are glues and lacquers.

A variety of devices of this type are known in the art, most of which employ a squeezable container and some of which include an applicator for applying the product to a surface. Where the application includes a sponge which spreads the fluid to a treated surface, there is a need to protect both the sponge from drying between periods of use and the drying of the contained fluid which can destroy the utility of the sponge. There thus arises a need for an improved construction which will provide for protecting the sponge from drying and clogging when not in use. A further need is the ability, when using viscous dispersants, to transfer the same directly to the surface being treated without the necessity of first passing the same through the body of the sponge. It is also desirable to provide a device having a frangible seal disposed in a neck portion of a container element which when opened is positioned in a centrally-disposed channel leading directly to the outer surface of the sponge.

SUMMARY OF THE INVENTION

Briefly stated, the invention contemplates the provision of an improved device of the type described particularly suited for commercial use in the spreading of relatively viscous coatings such as glue and the like to a surface using a sponge supported by a rigid applicator threadedly engaged upon one end of a flexible tube-like container. The container includes a threaded neck surrounding a frangible membrane positioned at a first end of a passage in a threadedly-engageable applicator element which communicates with a corresponding passage in the sponge, so that the applied coating may be applied directly to the surface being treated. It is spread by the outer exposed planar surface of the sponge. At the completion of the coating application, the exposed surface of the sponge may be wiped clear of coating material. A threaded cap protects the surface pending subsequent use.

BRIEF DESCRIPTION OF THE DRAWING

In the drawing, to which reference will be made in the specification.

DETAILED DESCRIPTION OF THE DISCLOSED EMBODIMENT

Figure 1:
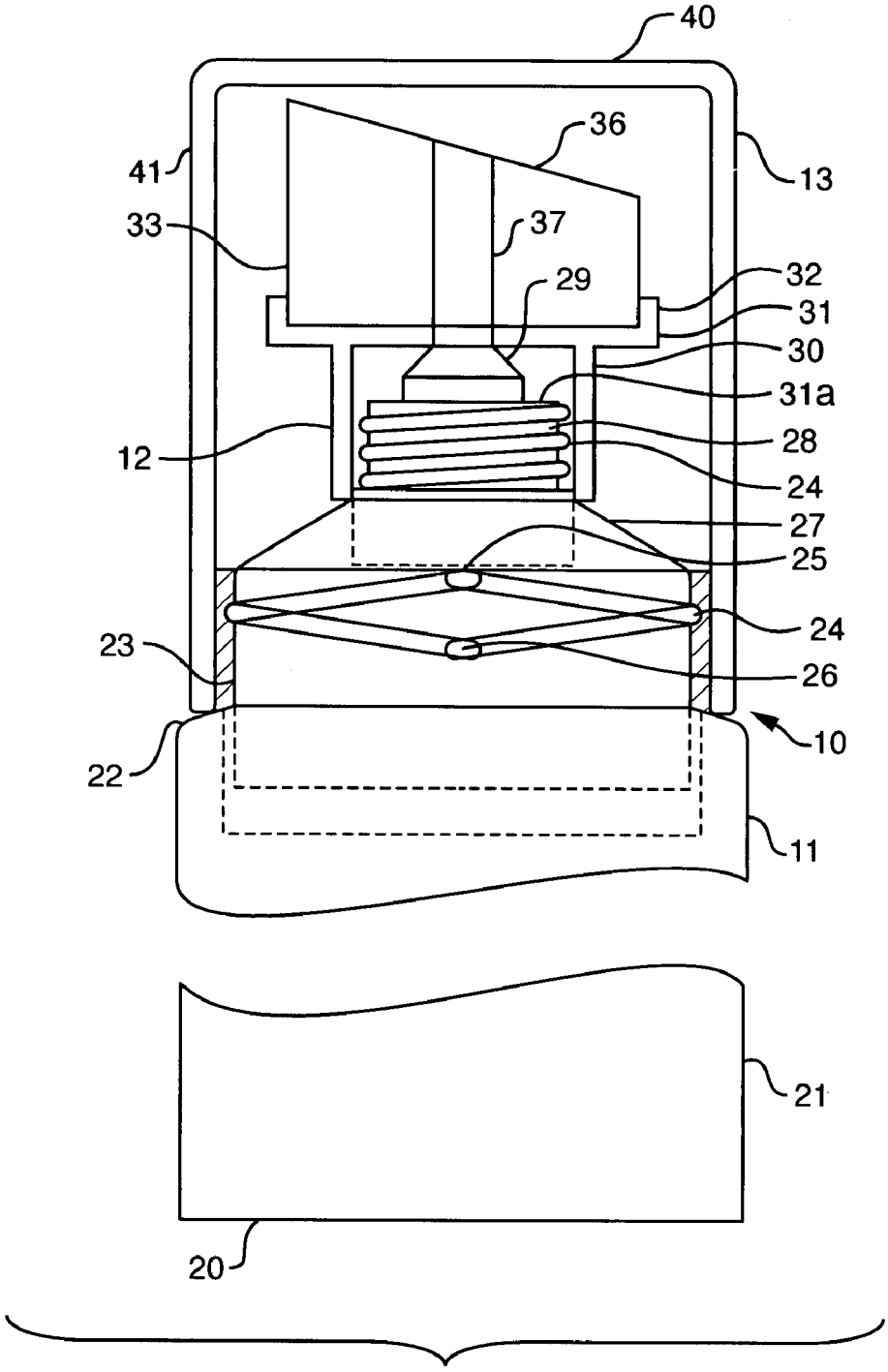
FIG. 1 is a fragmentary sectional view, partly in elevation of a preferred embodiment of the invention.

With reference to the drawing, the device, generally indicated by reference character 10, comprises broadly: a fluid container element 11, a dispensing element 12, and a cover or cap element 13.

The container element 11 is of known type, preferably formed as an extrusion of polyethylene or similar material. It is closed by a bottom wall 20 and includes an arcuate side wall 21 which, at the upper end 22 thereof is of reduced size to provide a cover-engaging member 23. The outer surface of the cover-engaging member includes a first thread 24 of relatively short length terminating at first and second ends 25 and 26. A neck portion 27 has an upper surface 31*a* and includes a second set of threads 28 adapted to engage the dispensing element 12.

The dispensing element 12 is also of molded construction, and includes an internally-threaded sleeve 30, as well as a radially-extending member 31 having an axially aligned flange 32 forming a circular socket adapted to engage a dispensing sponge member 33 of cylindrical configuration.

The cover or cap element 13 is of molded construction, and includes an end wall 40 and a side wall 41 having an inner surface with threads corresponding to the first thread 24 for rapid engagement and disengagement.

Use of the device will be apparent from a consideration of the drawing. Once the cover element is unthreaded, the frangible extension 29 on the end of the container element is cut or punctured to provide communication to the exterior of the container element. The dispensing element is then re-engaged to provide communication to the outer surface 36 of the sponge through the passage 37.

The container element is then manually squeezed to propel the contents therein to be spread on a treated surface (not shown) which operation may be repeated as often as necessary.

When the device is to be stored, the surface 36 of the sponge is carefully wiped, and the passage 37 cleaned, if desired, usign a dowel or similar article. The cap element 13 is then replaced for storage wherein it precludes circulation of ambient air.

Upon a second usage, the cap element is removed to ready the device for application of fluid until the contents of the container element are exhausted, following which the device is discarded.

It is noted that the sponge member is preferably of relatively fine porous material so as to afford only limited absorption of the liquid being dispensed.

It may thus be seen that I have invented novel and highly useful improvements in liquid dispensing devices particularly suited for the spreading of relatively viscous fluids, such as glue directly onto a treated planar surface to be spread by a flexible sponge member which can be easily cleaned between uses. The device includes a dispensing element supporting the sponge which is provided with an axially-disposed passage communicating with a squeezable container element which is sealed prior to first usage.

I wish it to be understood that I do not consider the invention to be limited to the precise details of structure disclosed in the specification, for obvious modifications will occur to those skilled in the art to which the invention pertains.

The invention claimed is:

1. A device for dispensing fluids which dry and harden with ambient exposure consisting of: an flexible container element including a arcuate side wall having an upper end of reduced size forming a cover-engaging member, said cover-engaging element having an axially-disposed first thread thereon, and having a neck portion having a coaxial second thread thereon, and a frangible extension defining an axially-aligned seal extending above said neck portion for protecting the contents of the container element prior to first use; a dispenser element threadedly engageable upon said second thread with an internally threaded sleeve and a radially-extending member wherein said radially extending member contacts said frangible extension and is spaced from an upper surface of said neck portion when fully seated on said neck portion an axially-aligned flange forming with said radially-extending member a circular socket; a sponge member of cylindrical configuration engaged within said socket, said sponge member having an exposed surface and an axially-aligned passage extending therethrough communicating with said neck portion of said container element; said container element having a frangible seal; said upper end of; and a cap element having an internal short length thread selectively engageable with said first thread to enclose said dispenser element and sponge member; whereby said cap element may be rapidly engaged and removed for serial use of said device since said cap rotates through a lesser angle than said dispensing element to be fully seated.

* * * * *